US006273778B1

(12) United States Patent
Kyster

(10) Patent No.: US 6,273,778 B1
(45) **Date of Patent: *Aug. 14, 2001**

(54) TOY BUILDING SET

(75) Inventor: Steen Kyster, Vanløse (DK)

(73) Assignee: INTERLEGO AG, Baar (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/508,809

(22) PCT Filed: Sep. 17, 1998

(86) PCT No.: PCT/DK98/00400

§ 371 Date: Jul. 10, 2000

§ 102(e) Date: Jul. 10, 2000

(87) PCT Pub. No.: WO99/16523

PCT Pub. Date: Apr. 8, 1999

(30) Foreign Application Priority Data

Sep. 18, 1997 (DK) ..... 1074/97

(51) Int. Cl.[7] ..... A63H 29/08; A63H 33/04
(52) U.S. Cl. ..... 446/168; 446/85
(58) Field of Search ..... 446/75, 85, 89, 446/128, 166, 168

(56) References Cited

U.S. PATENT DOCUMENTS

| | | | | |
|---|---|---|---|---|
| 2,950,130 | * | 8/1960 | Schneider | 285/67 |
| 3,069,805 | * | 11/1962 | Burrows | 446/89 |
| 3,205,611 | * | 9/1965 | Onanian | 446/124 |
| 3,302,949 | * | 2/1967 | Wolfe | 446/89 |
| 3,469,339 | | 9/1969 | Thomas . | |
| 4,080,752 | * | 3/1978 | Burge | 446/89 |
| 5,015,210 | * | 5/1991 | Dideriksen | 446/128 |
| 5,112,263 | * | 5/1992 | Penillard et al. | 446/89 |
| 5,180,323 | | 1/1993 | Justice . | |
| 5,385,472 | * | 1/1995 | Mullin | 446/89 |
| 5,451,177 | | 9/1995 | Gilman . | |
| 5,480,336 | * | 1/1996 | Blanchard | 446/89 |

FOREIGN PATENT DOCUMENTS

| | | |
|---|---|---|
| 27 20 641 | 11/1977 | (DE) . |
| 115237 | 9/1969 | (DK) . |
| 2 427 835 | 1/1980 | (FR) . |
| 2 171 022A | 8/1986 | (GB) . |

* cited by examiner

*Primary Examiner*—Jacob K. Ackun, Jr.
*Assistant Examiner*—Fay Francis
(74) *Attorney, Agent, or Firm*—Pitney, Hardin, Kipp & Szuch LLP

(57) ABSTRACT

A toy building set with toy building elements having coupling means in the form of projecting studs and corresponding cavities which allow interconnection of building elements, has a building element with an integrated pipe member with a female end and a male end having complementary snap coupling means for connection with other pipe members.

7 Claims, 2 Drawing Sheets

TOY BUILDING SET

The invention relates to a toy building set having interconnectible building elements with coupling studs and coupling cavities which are capable of receiving coupling studs on other toy building elements of the toy building set.

Such toy building sets are known and marketed under the trade marks LEGO or DUPLO and are used by young and older children for the building of imaginative structures where only the imagination sets the limits.

DK 115 237 discloses a toy building set for the building of a ball track. The building set has interconnectible pipe members having a ball-shaped part in the centre and building elements having a ball-cup-shaped opening to receive and hold the ball-shaped part of a pipe member. The pipe member is hereby mounted in a ball joint in the building element.

U.S. Pat. No. 5,451,177 discloses a toy building set having interconnectible building elements and pipe members which per se cannot be built together. Some of the building elements have a semi-cylindrical recess in the top side or in the underside, whereby two building elements together can surround the ends of two pipe members. The ends of the pipe members have a flange which hereby engages a corresponding groove in the semi-cylindrical recesses. Thus, two building elements have to be used in order to assemble two pipe members.

U.S. Pat. No. 4,080,752 discloses a toy building set having pipe members and building blocks which can be assembled in a fluid tight manner by means of O-rings.

The object of the invention is to provide a toy building set having interconnectible building blocks and interconnectible pipe members by means of which even small children, who have no great deftness as yet, can easily build structures having a great play value.

This object is achieved according to the invention in that a building block of the building set has a pipe member firmly integrated in the building block. The pipe member is thus in a fixed position with respect to the building block, which is a help to the child in its play, and with curved pipe members it is possible to assemble longer pipes with curves. The lengths and curves of the pipe members may thus be adapted to the dimensions of the building elements, thereby allowing a flexible and modular system to be created.

Figure 1:
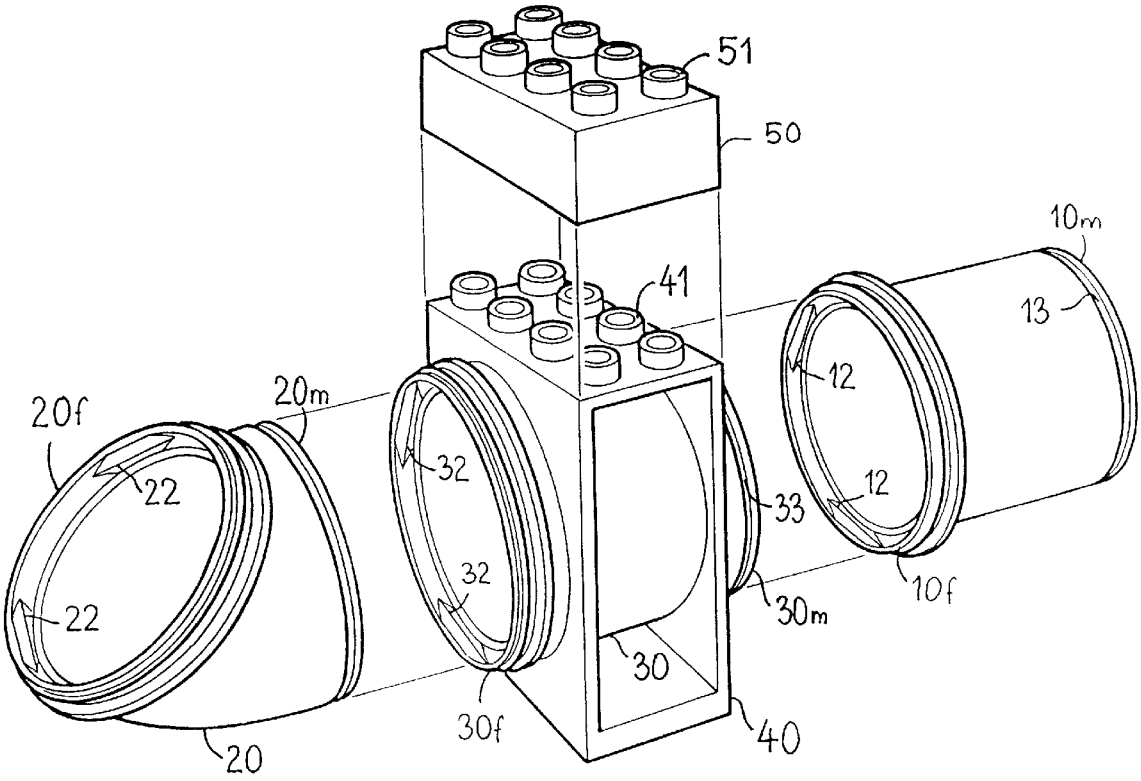
Figure 2:
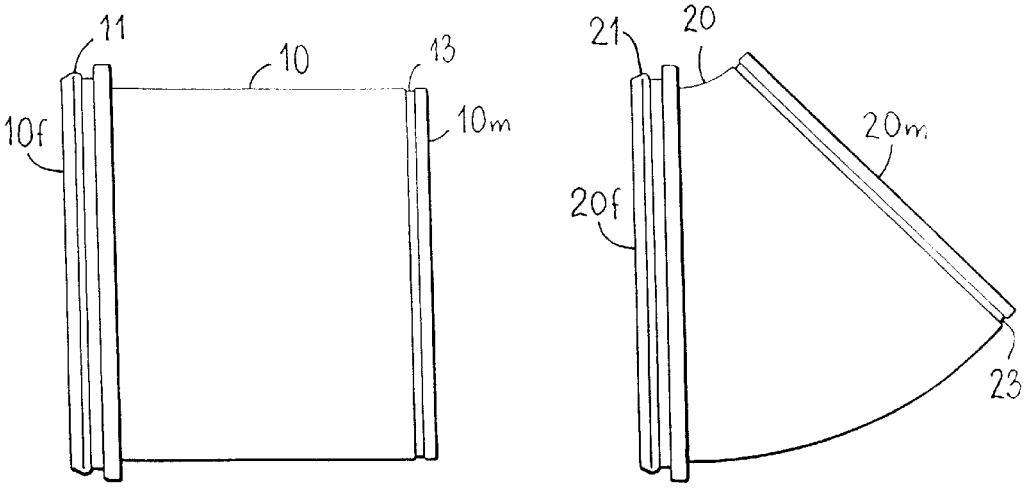
Figure 3:
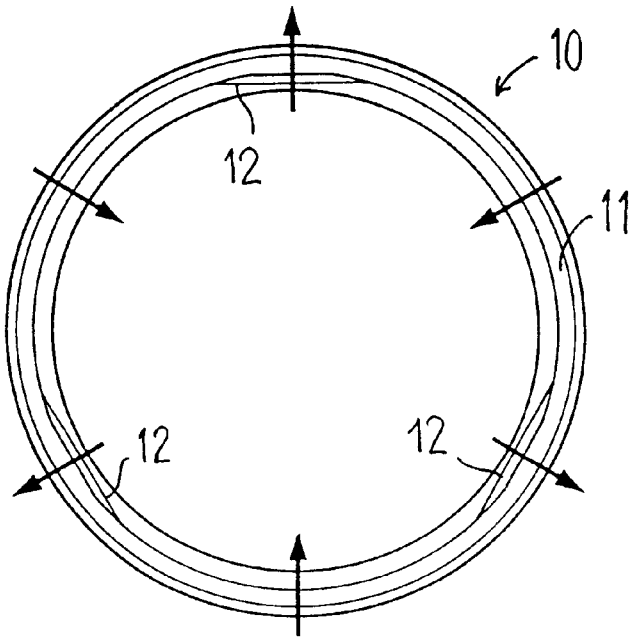

The invention will be described more fully below with reference to the drawings, in which FIG. 1 shows elements of a toy building system and a pipe system in a preferred embodiment of the invention, FIG. 2 shows two pipe members which form part of the pipe system in FIG. 1, and FIG. 3 shows the deformation of a pipe during assembly and disassembly.

FIG. 1 shows three pipe members 10, 20, 30 which are made of a suitable plastics material, such as ABS, and all have the same cross-section, which is circular in the preferred embodiment. Each of the pipe members 10, 20, 30 has a female end 10*f*, 20*f* and 30*f*, respectively, and a male end 10*m*, 20*m* and 30*m*, respectively. The pipe members 10 and 30 are straight, and their respective male ends 10*m*, 30*m* are parallel with the corresponding female ends 10*f*, 30*f*. The pipe member 20 is curved and forms an angle of 45 degrees, that is its female end 20*f* forms an angle of 45 degrees with its male end 20*m*.

At its female end 10*f*, the pipe member 10 has a collar 11 of greater diameter than the rest of the pipe member. The internal side of the collar 11 has some studs or projections 12 which are evenly distributed along the internal side of the collar 11. Three such projections 12 are provided here.

Correspondingly, at its female end 20*f*, the pipe member 20 has a collar 21 with projections 22 on the inner side. The collar 21 with the projections 22 is here identical with the corresponding collar 11 with projections 12 on the pipe member 10. Correspondingly, also the pipe member 30 has a collar 31 with projections 32 on the inner side at its female end 30*f*. Also the collar 31 with projections 32 is identical with the corresponding collar 11 with projections 12 on the pipe member 10.

At its male end 10*m*, the pipe member 10 has an uninterruptedly extending, ring-shaped depression or groove 13 on its outer side. Correspondingly, also the pipe members 20 and 30 each have a groove 23, 33 at their respective male ends 20*m*, 30*m* on their outer sides.

The collars on the female ends of the pipe members have such an internal diameter that they can receive a male end on another pipe member. When the male end of a pipe member is moved into the collar on the female end of another pipe member, the outer end of the male end will contact the projections on the inner side of the collar and push the projections radially outwards. When the male end of the pipe member is moved further into the collar, the projections on the inner side of the collar will snap into the groove on the outer side of the male end and hold the male end.

This snap mechanism, which is formed by the projections on the inner sides of the collars and the grooves on the outer sides of the male ends, is configured such that a child can easily assemble and disassemble the pipe members again.

FIG. 3 shows the straight pipe member 10 seen toward its female end 10*f*. It will be seen that the three projections 12 are equidistantly distributed along the inner side of the collar 11. It is shown by arrows how the collar 11 will be deformed when the male end of another pipe member is inserted into the collar 11 on the pipe member 10 before the projections snap into the groove on the male end. The collar will be deformed outwards at the projections, and the collar will correspondingly be deformed inwards in the spaces between the projections. Corresponding, but oppositely directed deformations will take place on the male end of the other pipe member. Thus, a purely flexural deformation is involved, and essentially no stretching or compression of the material takes place.

When pipe members have been assembled and the projections on the inner side of the collar of the female end are in engagement with the groove on the outer side of the male end, the pipe members will be in a substantially neutral state of tension, and therefore no permanent deformation will occur even after prolonged interconnection.

In FIG. 1, the pipe member 30 is shown interconnected with a toy building element 40 belonging to a toy building set of a known type. The toy building element 40 has cylindrical coupling studs 41 on its top side. FIG. 1 shows a further toy building element 50 belonging to the known toy building set, and this toy building element 50 has cylindrical coupling studs 51 of the same type as the coupling studs 41 on its top side. The undersides of the toy building elements 40 and 50 are formed with cavities capable of receiving coupling studs on other building elements in frictional engagement, and several building elements may hereby be built together in a known manner. It is indicated in FIG. 1 that the building element 50 may be built in this manner on top of the building element 40 with the pipe member 30.

The building element 40 may also be built on top of the building element 50 or other building elements of the toy building set, and the building element 40 together with the pipe system with pipe members are thus incorporated as new building elements in the known toy building set, and hereby the known toy building set has obtained quite new possibilities of play.

Several pipe sections may be assembled by means of the coupling mechanism with female ends and male ends described above, so that e.g. a ball track for young children may be built, or the pipe system may simulate a ventilating duct in a building built with a larger number of building elements for the use of older children.

What is claimed is:

1. A toy building set comprising interconnectable toy building blocks each having a first face with at least one coupling stud extending from the first face and defining a coupling axis perpendicular to the first face, and a second face with a coupling cavity extending from the second face into the block, the at least one coupling stud and the coupling cavity allowing, by relative movement of the two blocks in the direction of the coupling axis, interconnection of two such blocks by receiving the at least one coupling stud on one building block in the cavity of another block;

the toy building set further including one such block having a tubular portion defining a tube axis transverse to the coupling axis, the tubular portion extending between opposite sides of the block having the tubular portion and defining a through opening along the tube axis; and at least one tube;

the tubular portion and the tube each having a male end and a female end capable of receiving a male end of another tube or tubular portion.

2. A toy building set according to claim 1, wherein at least one of the male end and the female end of the tubular portion define a plane, which is parallel with one of the opposite sides of the block having the tubular portion.

3. A toy building set according to claim 1, wherein the male end and the female end of at least one tube define respective planes in parallel with each other.

4. A toy building set according to claim 1, wherein at least the male end and the female end of the at least one tube define respective planes which form an acute angle.

5. A toy building set according to claim 1, wherein the male ends and the female ends have cooperating snap means adapted to retain a male end received in a female end.

6. A toy building set according to claim 5, wherein the snap means ends are three or more projections evenly distributed on the inner side of the female end.

7. A toy building set according to claim 6, wherein the snap means of the male end is a peripherally extending, uninterrupted groove on the outer side of the male end.

* * * * *